US010173226B2

(12) United States Patent
Borra et al.

(10) Patent No.: US 10,173,226 B2
(45) Date of Patent: Jan. 8, 2019

(54) DEVICE FOR CONTROLLING THE CHARGE OF AN AEROSOL POST-DISCHARGE

(71) Applicant: Centre National de la Recherche Scientifique (CNRS), Paris (FR)

(72) Inventors: Jean-Pascal Borra, Velizy (FR); Nicolas Jidenko, Saint Remy les Chevreuse (FR)

(73) Assignee: CENTRE NATIONAL DE LA RECHERCHE SCIENTIFIQUE (CNRS), Paris (FR)

( * ) Notice: Subject to any disclaimer, the term of this patent is extended or adjusted under 35 U.S.C. 154(b) by 559 days.

(21) Appl. No.: 14/655,550

(22) PCT Filed: Dec. 23, 2013

(86) PCT No.: PCT/EP2013/077947
§ 371 (c)(1),
(2) Date: Jul. 21, 2015

(87) PCT Pub. No.: WO2014/102257
PCT Pub. Date: Jul. 3, 2014

(65) Prior Publication Data

US 2015/0352563 A1 Dec. 10, 2015

(30) Foreign Application Priority Data

Dec. 27, 2012 (FR) ..... 12 62849

(51) Int. Cl.
*B03C 3/36* (2006.01)
*B03C 3/38* (2006.01)

(52) U.S. Cl.
CPC ..... *B03C 3/361* (2013.01); *B03C 3/38* (2013.01)

(58) Field of Classification Search
CPC ..... B03C 3/38; B03C 3/361
(Continued)

(56) References Cited

U.S. PATENT DOCUMENTS 4,339,782 A * 7/1982 Yu ..... H01T 23/00 361/229
2003/0072675 A1* 4/2003 Takeda ..... A61L 9/22 422/22

(Continued)

FOREIGN PATENT DOCUMENTS

EP 1175943 A1 1/2002
GB 2079187 A 1/1982

OTHER PUBLICATIONS

French Preliminary Search Report for Application No. 1262849 dated Oct. 3, 2013.

*Primary Examiner* — Kevin J Comber
(74) *Attorney, Agent, or Firm* — Baker & Hostetler LLP

(57) ABSTRACT

The invention concerns a device for controlling the charge of an aerosol comprising: —an aerosol inlet area; —a discharge area having dielectric barriers, in which charged species are generated, the discharge area and the aerosol inlet area being arranged relative to one another in such a way that the aerosol introduced in this way does not flow via the discharge area; —a mixing area for mixing the aerosol with a portion of the charged species from the discharge area; —a post-discharge area linked to the discharge area, the aerosol inlet area and the mixing area being arranged in such a way that at least a portion of a stream flowing in the post-discharge area drives at least a portion of the charged species formed in the discharge area and expelled from the discharge area by electrostatic repulsion towards said mixing area.

20 Claims, 7 Drawing Sheets

(58) Field of Classification Search
USPC ..... 361/213
See application file for complete search history.

(56) References Cited

U.S. PATENT DOCUMENTS

| | | | | |
|---|---|---|---|---|
| 2005/0142047 | A1* | 6/2005 | Baik | A61L 9/205<br>422/186.04 |
| 2011/0096457 | A1* | 4/2011 | Gefter | H01T 23/00<br>361/230 |
| 2013/0265689 | A1* | 10/2013 | Kasper | B03C 3/06<br>361/231 |

* cited by examiner

DEVICE FOR CONTROLLING THE CHARGE OF AN AEROSOL POST-DISCHARGE

CROSS REFERENCE TO RELATED APPLICATIONS

The present application is a national phase entry under 35 U.S.C. § 371 of International Application No. PCT/EP2013/077947, filed Dec. 23, 2013, published in French, which claims priority from French Patent Application No. 1262849, filed Dec. 27, 2012, the disclosures of which are incorporated by reference herein.

FIELD OF THE INVENTION

The present invention relates to a device for controlling the charge of an aerosol and more particularly relates to a device for controlling the charge of an aerosol using dielectric barrier discharges.

PRIOR ART

An aerosol is a collection of particles, solid or liquid, of a chemical substance or a mixture of chemical substances in suspension in a gaseous medium. The term "neutralized aerosol" is an aerosol wherein the mean charge of the particles in suspension is almost zero (i.e. an elementary charge between −1 and +1) and when the distribution of the charge levels is of "Boltzmann" or "unimodal" type. The term "charged species" refers here to gas ions, positive and negative, and electrons.

Devices are known for controlling the charge of an aerosol.

Among these devices, radioactive devices are known that produce bipolar ions with equal densities for neutralizing an aerosol. However, apart from the high cost of these radioactive devices, the legislative restrictions associated with their use are strict (permission required, requirement for a person with radioprotection skills, regular monitoring of the tightness of the source, and treatment of radioactive waste.)

Devices are moreover known for controlling the charge of an aerosol using atmospheric pressure discharges, either in two unipolar discharges of corona type or using dielectric barrier discharges. However, in this type of device, the electrodes are in contact with the aerosol: a fraction of the aerosol is charged by collection of ions produced by the discharge and a fraction of this fraction is collected electrostatically on the electrodes, which results in a modification of the shape and the nature of the electrodes and thus a modification of the discharge and a discharge stability problem.

Electrical discharges produce reactive gas species that can react with the gas species of the aerosol to form condensable gas species that give rise to new particles which affect the granulometric distribution of the aerosol to be characterized by neutralization.

Electrical discharges produce ozone and nitrogen oxide. These gas species are oxidants and therefore liable to damage materials or have adverse effects on health.

SUMMARY OF THE INVENTION

The invention makes it possible to palliate the aforementioned drawbacks by proposing a device for controlling the charge of an aerosol not using any radioactive materials, and wherein the neutralized aerosol contains little or no toxic waste (ozone and nitrogen oxides produced by the discharges).

For this purpose, the invention proposes a device for controlling the charge of an aerosol comprising:

- an aerosol inlet area;
- a discharge area having dielectric barriers, wherein charged species are generated, the discharge area and the aerosol inlet area being arranged relative to one another in such a way that the aerosol introduced in this way does not flow via the discharge area;
- a mixing area for mixing the aerosol with a portion of the charged species from the discharge area;
- a post-discharge area linked to the discharge area, the aerosol inlet area and the mixing area being arranged in such a way that at least a portion of a stream flowing in the post-discharge area drives at least a portion of the charged species formed in the discharge area and expelled from the discharge area by electrostatic repulsion in the direction of said mixing area.

The invention is advantageously completed by the following features, taken individually or in any one of their technically possible combinations:

- the stream flowing in the post-discharge area is the aerosol;
- the device comprises a dry air inlet area linked to the discharge area, in such a way that said dry air flows in the discharge area;
- the device comprises a dry air inlet area linked to the post-discharge area in such a way as to drive the charged species from the discharge area toward the post-discharge area;
- the discharge area comprises two plates of dielectric material arranged one facing the other and forming a duct and two main electrodes, each connected to a dielectric plate, the main electrodes being adapted for generating charged species in said discharge area;
- the discharge area having a dielectric barrier comprises two cylinders of dielectric material defining between them a duct and two concentric annular main electrodes, a so-called outer electrode being in contact with the outer wall of the outer cylinder and a so-called inner electrode being in contact with the inner wall of the inner cylinder, the main electrodes being adapted for generating charged species in said discharge area;
- the discharge area having a dielectric barrier comprises a tube made of dielectric material equipped with a flared mouth, a plate of dielectric material positioned facing the mouth of the dielectric tube, the tube made of dielectric material and the plate of dielectric material defining between them a duct, a first annular electrode, in contact with the outer wall of the dielectric tube at the flare of the dielectric tube and a second annular electrode with a diameter substantially identical to the diameter of the first electrode and in contact with the face of the dielectric plate opposite the dielectric tube, the main electrodes being adapted for generating charged species in said discharge area;
- the duct has a constriction, the main metal electrodes being positioned at said constriction in order that the resultant of the electrostatic repulsion forces that are exerted between the charged species formed in the discharge area is directed toward the post-discharge area;
- the main metal electrodes have a shape such that they are narrower on the side opposite the post-discharge area than on the side of the post discharge area in such a way that the resultant of the electrostatic repulsion forces exerted between the charged species formed in the discharge area is directed toward the post-discharge area:

the duct has a constriction, the discharge area further comprising two secondary metal electrodes forming with the main metal electrodes a discharge area having a secondary dielectric barrier on the surface of the duct;

the device comprises a generator of a high alternating voltage connected to the main electrodes in such a way as to cause the formation of positive and negative charged species in the discharge area;

the post-discharge area further comprises a post-discharge electrode adapted for controlling the charge;

the contacts between the main metal electrodes and the dielectric plates are coated with an insulating material;

the mixing area is defined by a duct, said duct being composed of two semicylindrical electrodes, powered by an alternating current generator, in such a way as to form an oscillating field in the mixing area;

the mixing area is defined by a duct, said duct being composed of three electrodes powered by a three-phase current generator, in such a way as to form a rotating field in the mixing area.

The advantages of the invention are many.

With the invention, the mixing of the charged species and the particles carried out post-discharge makes it possible to avoid fouling the discharge area, which is critical for the stability of the charged species source. Furthermore, the ratio of the densities of the charged species can be adjusted, either by imposing a (voltage, gas flow rate) pair ensuring they have identical densities or by an electrode positioned in the post-discharge.

In particular, the invention has an application in the measurement of the size and concentration of aerosols using an electrical mobility analyzer. The aerosols having been previously neutralized, the positively or negatively charged fraction is sorted by an electrostatic field in a differential mobility analyzer. The aerosols are then counted by electrical mobility range. The electrical mobility being related to the size of the particles, an inversion of the data makes it possible to obtain the size distribution of the particles.

BRIEF DESCRIPTION OF THE FIGURES

Other features, aims and advantages of the present invention will become more apparent on reading the following detailed description, given by way of non-limiting example and with reference to the appended figures among which.

In all the figures, similar elements bear identical reference numbers.

DETAILED DESCRIPTION

Figure 1:
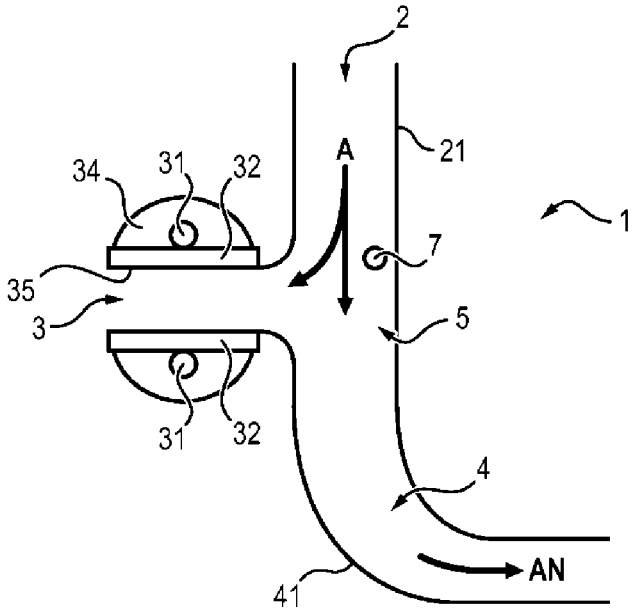
FIG. 1 illustrates a device for controlling the charge of an aerosol according to a first embodiment of the invention.
Figure 2:
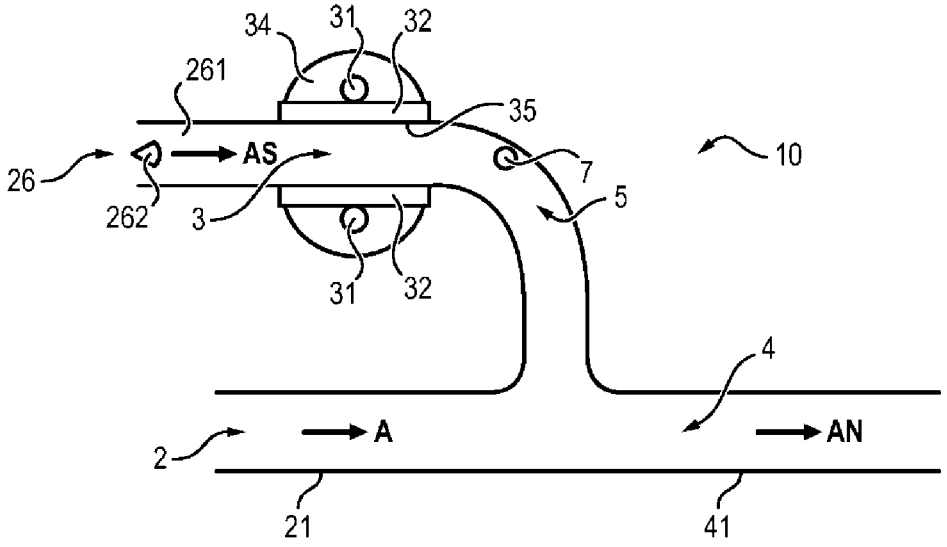
FIG. 2 illustrates a device for controlling the charge of an aerosol according to a second embodiment of the invention.
Figure 3:
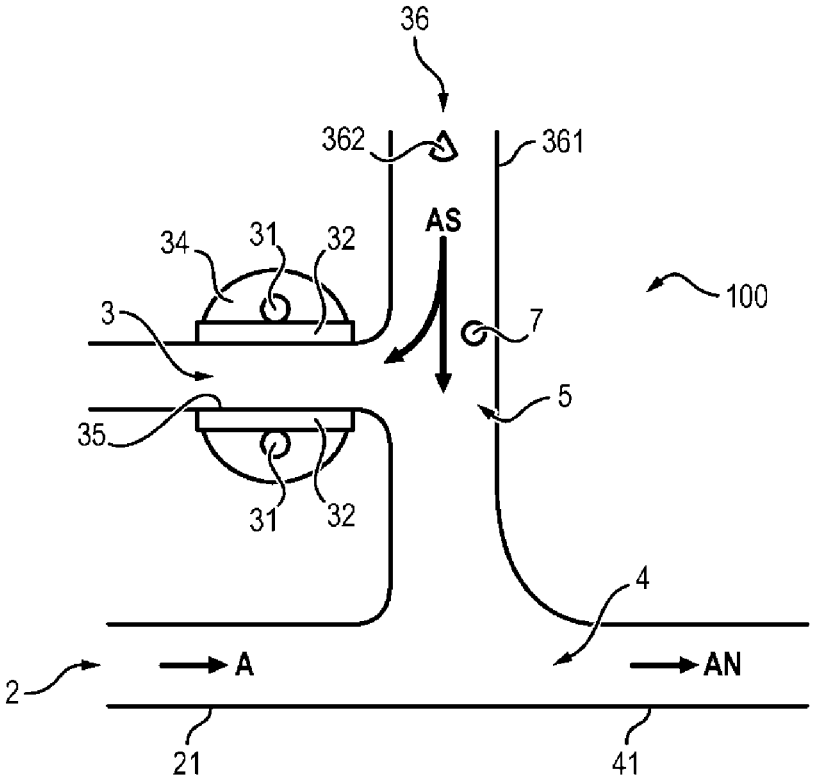
FIG. 3 illustrates a device for controlling the charge of an aerosol according to a third embodiment of the invention.

Relative to FIGS. 1, 2, 3, a device 1, 10, 100, for controlling the charge of an aerosol according to a first, a second, and a third embodiment of the invention comprises a discharge area 3 having a dielectric barrier, a first duct 21 defining an inlet area 2 of an aerosol A, a second duct 41 defining a mixing area 4, and a post-discharge area 5 located at the junction between the first duct 21, the second duct 41 and the discharge area 3.

Advantageously, the discharge area 3 having a dielectric barrier is composed of two plates 32 of dielectric material defining a third duct 35 and two main metal electrodes 31, each connected to a plate 32 of dielectric material. The dielectric material forming the plates is for example alumina, and the contacts 34 between the main metal electrodes 31 and the dielectrics 32 are made of an insulating material, for example a silicone paste with high dielectric strength. This makes it possible to avoid the presence of parasitic discharges which could occur outside the discharge area 3, i.e. between the plates 32.

In order to cause a discharge, the device comprises a high-voltage generator (not represented) adapted for biasing the main electrodes 31. For example the main electrodes 31 are biased by a high alternating voltage of a few kilovolts (for example a peak amplitude of 6 kilovolts) with a frequency of 30 to 100 kHz.

In the discharge area 3, the discharge takes the form of a plasma filament of a few tens of micrometers for a duration of a few nanoseconds. The device being symmetrical, the filaments occurring in the positive and negative voltage half-cycles are identical. In particular, within a same voltage half-cycle, the filaments are identical and distributed evenly between the main electrodes 32. Each filament is a local source of charged species.

Note that the applied voltage across the main electrodes 31 controls the number of filaments per half-period and the frequency of the supply voltage controls the repetition of this number of filaments over time. Finally, the distance between the plates 32 of dielectric material makes it possible to control, in the first order, the energy of the filaments of discharge. By way of example, the plates 32 are spaced apart so that the main electrodes are spaced apart by a distance between 0.5 and 2 mm.

According to the first embodiment of a device 1 for controlling the charge of an aerosol A, relating to FIG. 1, the discharge area 3 and the inlet area 2 of the aerosol A are arranged one relating to the other in such a way that the mixing of the charged species and the particles is carried out in the post-discharge area to avoid fouling the discharge area 3, which is critical for the stability of the source of charged species. The charged species leave the discharge area 3 by electrostatic self-repulsion against the stream. Specifically, the charged species of one and the same polarity repel each other, making it possible to extract a portion of the charged species produced in the post-discharge area 5 despite the stream of aerosol A.

The stream of aerosol A is injected into the first duct 21. This stream of aerosol A is separated in two. A portion of the stream of aerosol A is injected into the discharge area 3 to drive the gaseous effluent and prevent it from leaving the discharge area 3 on the side of the post-discharge area 5. The other part of the stream of aerosol A makes it possible to drive the extracted charged species toward the post-discharge area 5 where the mixing of the charged species/aerosols takes place.

Still according to the first embodiment, the gaseous effluents formed in the discharge area 3 are emptied, to be treated and not driven with the aerosol AN, the charge of which has been controlled (hereinafter "controlled-charge aerosol"). In this way, they do not modify the composition of the controlled-charge aerosol AN and do not run the risk of distorting any measurements carried out downstream on the controlled-charge aerosol AN. Furthermore, the surfaces of the dielectric plates 32 are cleaned by vaporizing the aerosols deposited by energy deposition at the bottom of the discharge filaments. In this way, the fouling of the discharge area 3 by the aerosols is reduced. Note that in the embodiments described here, a neutralized aerosol is preferably obtained.

Moreover, the device 1 for controlling the charge of an aerosol according to the first embodiment of the invention has the advantage of not using any additional air output and thus does not involve any dilution during the mixing of an aerosol with ionized air.

According to a second embodiment of a device 10 for controlling the charge of an aerosol, described relative to FIG. 2, the charged species generated in the discharge area 3 are driven toward the post-discharge area 5 by a stream of dry air AS.

In this second embodiment, apart from the elements described in relation to FIG. 1, the device 10 further comprises a fourth duct 261 opening into the discharge area 3 and defining a dry air AS inlet area 26 linked to the discharge area 3.

In order to inject the dry air AS into the duct 261, the device 10 according to the second embodiment comprises an injection nozzle 262 adapted for being coupled with a dry air source (not represented) and positioned at the inlet of the duct 261. The air injected by the nozzle 262 into the duct 261 passes into the duct 35 defined by the plates 32 of dielectric material. In this second embodiment, the charged species generated in the discharge area 3 are driven by the stream of dry air AS toward the mixing area 4. In this second embodiment, the aerosol A does not flow in the discharge area 3, which makes it possible to totally eliminate the fouling of the discharge area 3 by the aerosols.

According to a third embodiment of a device 100 for controlling the charge of an aerosol, described relative to FIG. 3, the device 100 further comprises a duct 361 opening into the post-discharge area 5 defining a dry air AS inlet area 36 linked to the post-discharge area 5. In order to inject the dry air AS into the duct 361, the device 100 comprises an injection nozzle 362 adapted for being coupled with a dry air source (not represented) and positioned at the inlet of the duct 361. A dry air stream AS is injected on the side where the charged species will be used to neutralize the aerosols. This dry air stream AS is separated in two. A portion of the dry air stream AS is injected into the discharge area 3 to drive the gaseous effluents and prevent them from leaving the discharge area 3 on the side of the post-discharge area 5. The other portion of the stream AS makes it possible to drive the charged species extracted toward the mixing area 4.

Advantageously, the duct 361 and the discharge area 3 can also be arranged in such a way that the dry air stream AS is not divided in two, but in such a way that all the dry air stream AS drains completely into the mixing area 4.

As for the second embodiment, the device 100 according to the third embodiment makes it possible to totally eliminate the fouling of the discharge area 3 by the aerosols, since the aerosol does not flow in the discharge area 3. Furthermore, in this third embodiment, the modification of the composition of the aerosol by the gaseous effluents is prevented since they are emptied to be treated, and not driven with the controlled-charge aerosol AN.

Ions and electrons are formed in the discharge area 3, such that the whole is electrically neutral overall. Although a portion of the electrons are attached to the gas molecules to form negative ions, a large portion of the negative ions are collected on the walls. In the discharge area 3, there is therefore an excess of positive ions.

The ions of the two polarities acquire the same mean velocity as the gas. However, the negative ions produced by ionization are smaller than the positive ions produced by ionization. The negative ions therefore have higher mechanical and electrical mobility than the positive ions. The mean electrical mobility of a negative ion is around 1.8 $cm^2 \cdot v^{-1} \cdot m^{-1}$ and that of a positive ion around 1.4 $cm^2 \cdot v^{-1} \cdot m^{-1}$. The negative ions therefore diffuse more quickly than the positive ions and in a given electric field, they acquire a higher electrostatic drift velocity than the positive ions. The consequence of this difference in electrical mobility is that the negative ions are lost more quickly at the walls than the positive ions. Thus, in the second embodiment, the ions are extracted from the discharge area 3 by a dry air stream AS, and an excess of positive ions is observed in the post-discharge area.

On the other hand, in the first and the third embodiment, the extraction takes place without a stream or against the stream, and an excess of negative ions is generally observed at the outlet because these are exclusively electrostatic effects that extract the ions (negative ions being more mobile, they are better extracted despite the excess of positive ions in the discharge). The excess of negative ions is attenuated over the journey of the ions through the post-discharge area, to finally return to an excess of positive ions. Thus, for each applied voltage between the main electrodes (defining the densities of the positive and negative ions in suspension in the discharge area 3 and the ratio of these densities), a flow rate condition exists making it possible to achieve constant densities of positive and negative ions in the post-discharge area 5.

In all the embodiments described, it is also possible to place a post discharge electrode 7 in the post-discharge area 5, 65 or 75 to control the charge of the aerosol A. It is for example possible, in all the embodiments described, to compensate for the difference in densities of positive and negative ions using the third electrode 7 positioned in the post-discharge area 5 before the ion-particle mixing is negatively biased by a direct voltage in the order of a hundred volts to collect the excess of positive ions. It is then possible to adjust the ratio of the densities of the positive and negative ions to obtain at the outlet of the device either the Boltzmann equilibrium, or an excess of positive or negative charge. It is thus possible to obtain a nonzero mean charge per particle. In particular, it is possible to obtain either the Boltzmann equilibrium with products of the ion densities and the electrical mobility positively and negatively equal, or equal densities as in conventional radioactive neutralizers, or else a positive or negative unipolar density.

If the effluents from the discharge are blown off, an electrode 7 of stainless steel will be chosen to limit their oxidization by the gas.

Figures 5, 6:
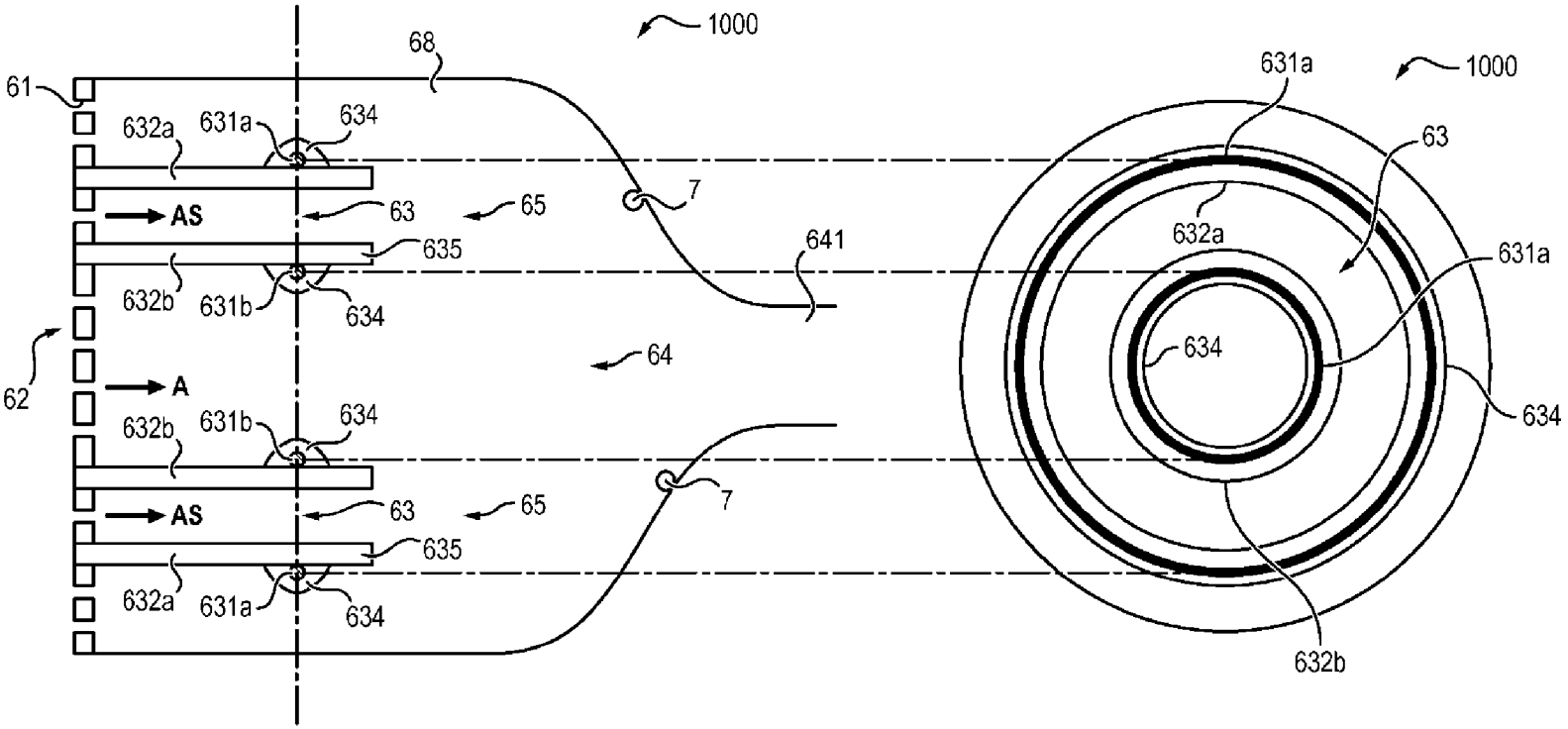
FIG. 5 is a longitudinal section view of a device according to a fourth embodiment.
FIG. 6 is a section view of the device in FIG. 5 in a plane T transverse to the plane in FIG. 5.

According to a fourth embodiment illustrated by FIGS. 5 and 6, the device 1000 comprises a discharge area 63 having a dielectric barrier composed of two concentric cylinders 632*a* and 632*b* of dielectric material (alumina for example)

and two annular main electrodes 631*a* and 631*b*. The two cylinders 632*a* and 632*b* and the two main annular electrodes 631*a* and 641*b* are also concentric. The outer electrode 632*a* is in contact with the outer wall of the outer cylinder 632*a* whereas the inner electrode 631*b* is in contact with the inner wall of the inner cylinder 631*b*. The device 1000 according to the fourth embodiment further comprises a tubular body 68 which surrounds the discharge area 63 and which butts onto a duct 641 that defines a mixing area 64. The body 68 is partly closed by drilled bushings 61, which simultaneously ensures the passage of the dry air AS or the aerosol A and, secondly, the centering of the dielectric cylinders 632*a* and 632*b*. The aerosol A inlet area 62 is defined by the inner cylinder 632*b*. The post-discharge area 65 is located between the duct 641 and the discharge area 63. The aerosol A is injected into the inner cylinder 632*b*. Dry air can be injected into the outer cylinder 632*a* and the inner cylinder 632*b* in such a way as to drive the ions created in the discharge area 63 in the direction of the post-discharge area 65. The space between the body 68 and the outer cylinder 632 allows any discharge effluents to leave.

Figure 7A:
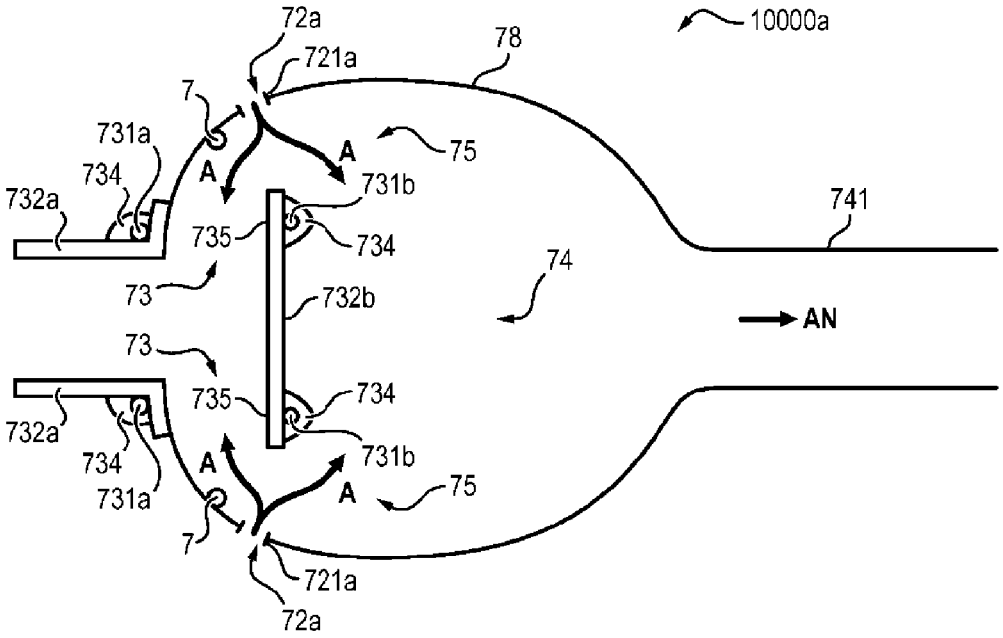
FIGS. 7*a*, 7*b* and 7*c* are longitudinal section views of three variants of a device according to a fifth embodiment.
Figure 7B:
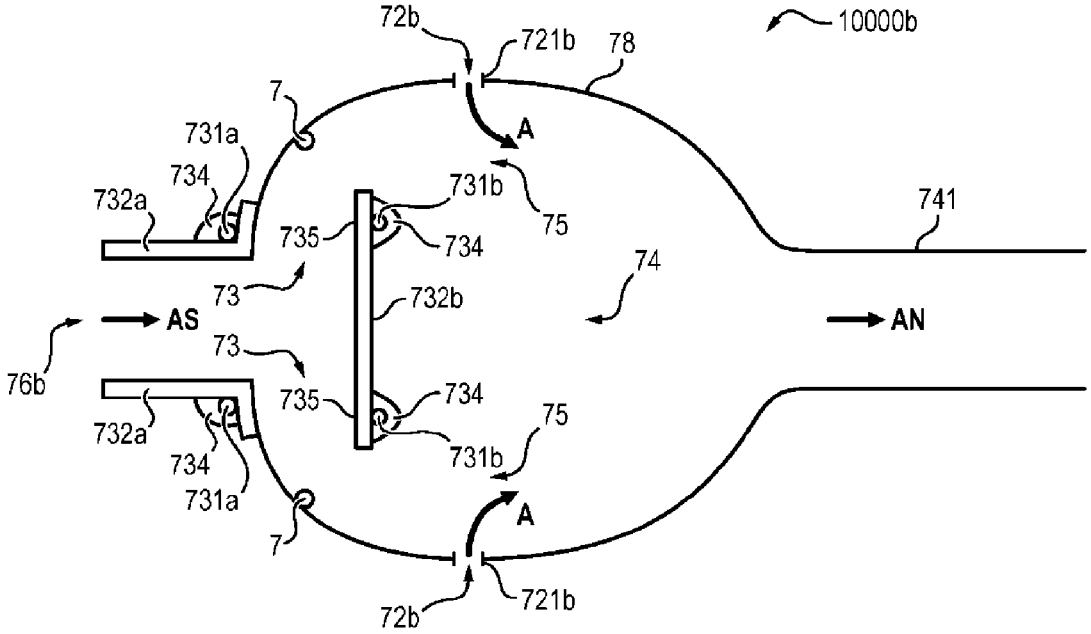
Figure 7C:
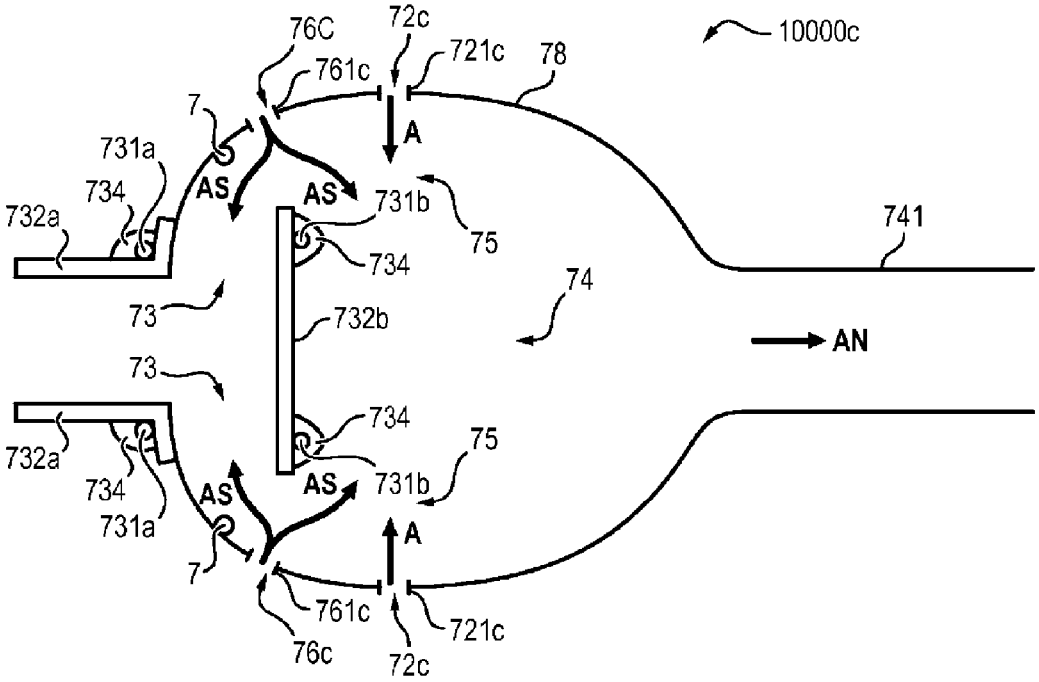

According to a fifth embodiment, illustrated by FIGS. 7*a*, 7*b* and 7*c*, the device 10000 for controlling the charge of an aerosol comprises a discharge area 73 having a dielectric barrier composed of a tube of dielectric material 732*a* (alumina for example) equipped with a flared mouth, and of a dielectric plate 732*b* positioned facing the mouth of the dielectric 732*a*. A first annular electrode 731*a* is in contact with the outer wall of the dielectric tube 732*a* at the flare of the dielectric tube 732*a* and of a second electrode 731*b* with a diameter substantially identical to the diameter of the first electrode 731*a*, and in contact with the face of the dielectric plate 732*b* opposite the dielectric tube 732*a*. The device (10000*a*, 10000*b*, 10000*c*) further comprises a body 78 which surrounds the discharge area 73 and is connected on the one hand to the mouth of the dielectric tube 732*a* and on the other to a duct 741 defining the mixing area 74. The post discharge area 75 is located between the duct 741 and the discharge area 73.

In a first variant embodiment illustrated by FIG. 7*a*, the body 78 of the device 10000*a* comprises one or more openings 721*a* located between the mouth of the dielectric tube 732*a* and the dielectric plate 732*b*, these openings defining the aerosol A inlet area 72*a*. The stream of aerosol A is injected into the device 10000*a* via the opening 72*a*. This stream A is separated in two. A portion of the stream A is injected into the discharge area 73 to drive the gaseous effluents and prevent them from leaving the discharge area 73 on the side of the post-discharge area 75. The other portion of the stream A drives the extracted ions toward the post-discharge area 75 where the ion-aerosol mixing takes place.

In a second variant embodiment illustrated by FIG. 7*b*, the body 78 of the device 10000*b* comprises one or more openings 721*b* located between the dielectric plate 732*b* and the duct 741 defining the mixing area 74, these openings defining the aerosol A inlet area 72*a*. The device 10000*b* further comprises a dry air AS inlet area 76*b* linked to the discharge area 73 in such a way that said dry air AS flows in the discharge area 73 and drives the ions produced in the discharge area 73 in the direction of the post-discharge area 75.

In a third variant embodiment illustrated by FIG. 7*c*, the body of the device 10000*c* comprises a first series of openings 721*c* located between the dielectric plate 732*c* and the duct 741 defining the mixing area 74, these openings 721*c* defining the aerosol A inlet area 72*c*. The body of the device 10000*c* further comprises a second series of openings 761*c* located between the mouth of the dielectric tube 732*c* and the dielectric plate 732*c*, these openings defining a dry air AS inlet area 76*c*. A dry air stream AS is injected into the device 10000*c* by the openings 761*c*. This stream AS is separated in two. A portion of the stream AS is injected into the discharge area 73 to drive the gaseous effluents and prevent them from leaving the discharge area 73 on the side of the post-discharge area 75. The other portion of the stream AS drives the extracted ions toward the post-discharge area 75.

In the fourth and fifth embodiments, the contacts 634 between the main metal electrodes 631*a* and 631*b* and the dielectrics 632*a* and 632*b* as well as the contacts 734 between the main metal electrodes 731*a* and 731*b* and the dielectrics 732*a* and 732*b* are made of an insulating material, for example a silicone paste with high dielectric strength, in order to avoid the presence of air around the main electrodes 631*a*, 631*b*, 731*a* and 731*b* and thus the formation of any parasitic discharges on the main electrodes outside the discharge area 63 and 73.

In all the embodiments described above, the arrangement of the discharge area 3 can be modified in such a way as to increase the quantity of charged species extracted from the discharge area 3 by electrostatic repulsion.

Figure 4A:
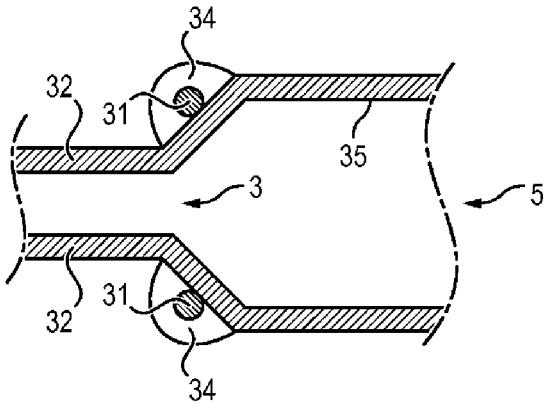
FIGS. 4*a*, 4*b* and 4*c* illustrate three possible arrangements for a discharge area of a device for controlling the charge of an aerosol according to the invention.
Figure 4B:
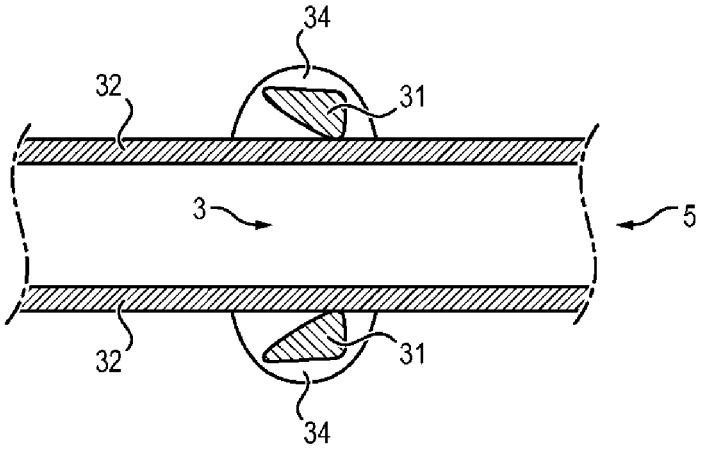
Figure 4C:
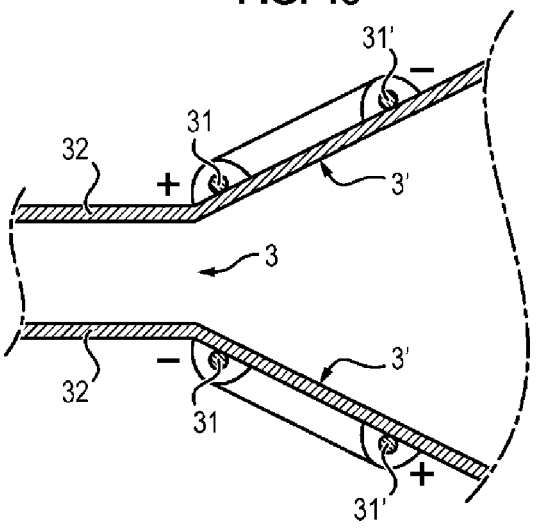

With reference to FIGS. 4, 4*b* and 4*c*, three possible variant embodiments of the discharge area 3 applicable to the embodiments described above will now be described.

In the first variant, illustrated in FIG. 4*a*, the two dielectric surfaces 32 form a duct 35 having a constriction, the duct 35 being wider on the side of the post-discharge area 5 than on the side opposite the post-discharge area 5. The main metal electrodes 31 are positioned at this constriction. The resultant of the electrostatic repulsion forces that are exerted between the charged species formed in the discharge area 3 is thus directed toward the post-discharge area 5, increasing the quantity of charged species extracted from the discharge area 3 by electrostatic repulsion.

In the second variant, illustrated in FIG. 4*b*, the main metal electrodes 31 have a shape such that they are narrower on the side opposite to the post discharge area 5 than on the side of the post-discharge area 5. The resultant of the electrostatic repulsion forces that are exerted between the charged species formed in the discharge area 3 is directed toward the post-discharge area 5, increasing the quantity of charged species extracted from the discharge area 3 by electrostatic repulsion.

In the third embodiment, illustrated in FIG. 4*c*, the duct 35, 635 or 735 has a constriction. The discharge area 3, 63 or 73 further comprises two main metal electrodes 31' of a similar shape to the main metal electrodes 31, 631 or 731 and positioned upstream of the constriction relative to the main metal electrodes 31, 631 or 731. The secondary metal electrodes 31' form with the main metal electrodes 31, 631 or 731*a* discharge area 3' having a secondary dielectric barrier on the surface of the duct 35, 635 or 735.

Figure 8A:
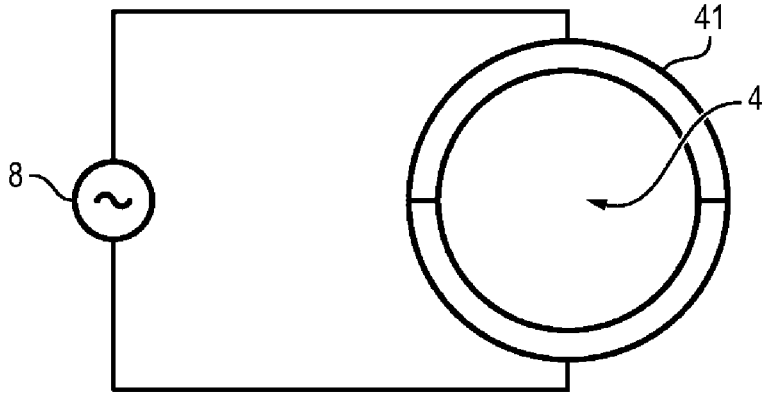
FIGS. 8*a* and 8*b* are cross section views of two variants of a mixing area of a device according to the invention.
Figure 8B:
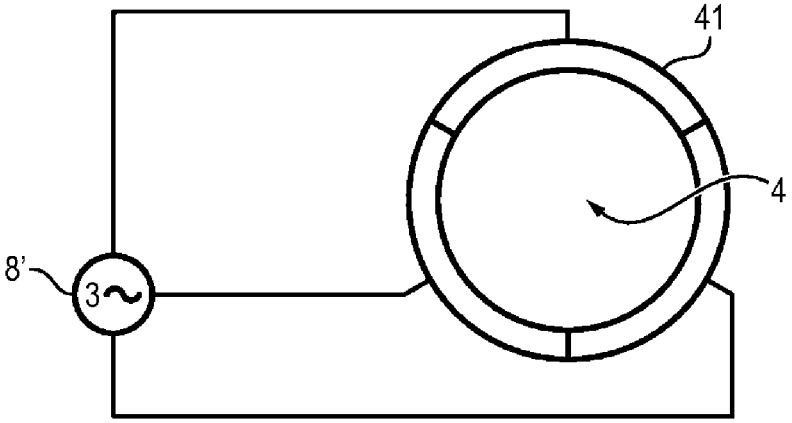

With reference to FIGS. 8*a* and 8*b*, the mixing area 4 of a device according to the invention is defined by a duct 41 and in order to limit losses of particles on the walls of the duct 41, the duct 41 is advantageously composed of two semicylindrical electrodes, powered by an alternating current generator 8, in such a way as to form an oscillating field in the mixing area 4. The duct 41 can also be composed of three electrodes powered by a three-phase current generator 8', in such a way as to form a rotating field in the mixing area 4. In all the embodiments described above, the mixing area 4, 64 or 74 can also be produced in this way.

The invention claimed is:

1. A device for controlling the charge of an aerosol comprising:

an aerosol inlet area;

a discharge area having dielectric barriers and at least two electrodes connected to a voltage supply operating at a frequency of at least 30 kHz and separated from the aerosol by the dielectric barriers, wherein the at least two electrodes generate positive and negative charged species in the discharge area, the discharge area and the aerosol inlet area being arranged relative to one another in such a way that the aerosol introduced in this way does not flow via the discharge area;

a mixing area for mixing the aerosol with a portion of the charged species from the discharge area; and a post-discharge area linked to the discharge area, the aerosol inlet area and the mixing area being arranged in such a way that at least a portion of a stream flowing in the post-discharge area drives at least a portion of the charged species formed in the discharge area and expelled from the discharge area by electrostatic repulsion in the direction of said mixing area.

2. The device for controlling the charge of an aerosol according to claim 1, wherein the stream flowing in the post-discharge area is the aerosol.

3. The device for controlling the charge of an aerosol according to claim 1, comprising a dry air inlet area linked to the discharge area in such a way that said dry air flows in the discharge area.

4. The device for controlling the charge of an aerosol according to claim 1, comprising a dry air inlet area linked to the post-discharge area in such a way as to drive the charged species from the discharge area toward the post-discharge area.

5. The device for controlling the charge of an aerosol according to claim 4, wherein the dielectric barriers comprising two plates of dielectric material arranged one facing the other and forming a duct, the at least two electrodes include two main electrodes each connected to a respective one of the dielectric plates.

6. The device for controlling the charge of an aerosol according to claim 5, wherein the duct has a constriction, the main metal electrodes being positioned at said constriction in order that the resultant of the electrostatic repulsion forces that are exerted between the charged species formed in the discharge area is directed toward the post-discharge area.

7. The device for controlling the charge of an aerosol according to claim 5, wherein the duct has a constriction, the at least two electrodes further comprising two secondary metal electrodes forming with the main metal electrodes a discharge area having a secondary dielectric barrier on the surface of the duct.

8. The device for controlling the charge of an aerosol according to claim 5, comprising a generator of a high alternating voltage connected to the main electrodes in such a way as to cause the formation of positive and negative charged species in the discharge area.

9. The device for controlling the charge of an aerosol according to claim 5, wherein the contacts between the main metal electrodes and the dielectric plates are coated with an insulating material.

10. The device for controlling the charge of an aerosol according to claim 5, wherein the mixing area is defined by a duct, said duct being composed of two semicylindrical electrodes, powered by an alternating current generator, in such a way as to form an oscillating field in the mixing area.

11. The device for controlling the charge of an aerosol according to claim 5, wherein the mixing area is defined by a duct, said duct being composed of three electrodes powered by a three-phase current generator, in such a way as to form a rotating field in the mixing area.

12. The device for controlling the charge of an aerosol according to claim 4, wherein the post-discharge area further comprises a post-discharge electrode adapted for controlling the charge.

13. The device for controlling the charge of an aerosol according to claim 1, wherein the dielectric barriers comprising two plates of dielectric material arranged one facing the other and forming a duct, the at least two electrodes include two main electrodes that are each connected to a respective one of the dielectric plates.

14. The device for controlling the charge of an aerosol according to claim 1, wherein the post-discharge area further comprises a post-discharge electrode adapted for controlling the charge.

15. A device for controlling the charge of an aerosol comprising:

an aerosol inlet area;

a discharge area having dielectric barriers, wherein charged species are generated, the discharge area and the aerosol inlet area being arranged relative to one another in such a way that the aerosol introduced in this way does not flow via the discharge area;

a mixing area for mixing the aerosol with a portion of the charged species from the discharge area; and a post-discharge area linked to the discharge area, the aerosol inlet area and the mixing area being arranged in such a way that at least a portion of a stream flowing in the post-discharge area drives at least a portion of the charged species formed in the discharge area and expelled from the discharge area by electrostatic repulsion in the direction of said mixing area, wherein the dielectric barriers comprising two cylinders of dielectric material defining between them a duct, and the discharge area further comprises two concentric annular main electrodes including an outer electrode that is in contact with an outer wall of an outer one of the two cylinders of dielectric material and an inner electrode that is in contact with an inner wall of an inner one of the two cylinders of dielectric material, the main electrodes being adapted for generating the charged species in said discharge area.

16. The device for controlling the charge of an aerosol according to claim 15, wherein the main metal electrodes have a shape such that they are narrower on a side opposite the post-discharge area than on a side of the post-discharge area, in such a way that the resultant of the electrostatic repulsion forces exerted between the charged species formed in the discharge area is directed toward the post-discharge area.

17. The device for controlling the charge of an aerosol according to claim 15, wherein the duct has a constriction, the discharge area further comprising two secondary metal electrodes forming with the main metal electrodes a discharge area having a secondary dielectric barrier on the surface of the duct.

18. A device for controlling the charge of aerosol comprising:

an aerosol inlet area;

a discharge area having dielectric barriers, wherein charged species are generated, the discharge area and the aerosol inlet area being arranged relative to one another in such a way that the aerosol introduced in this way does not flow via the discharge area;

a mixing area for mixing the aerosol with a portion of the charged species from the discharge area; and a post-discharge area linked to the discharge area, the aerosol inlet area and the mixing area being arranged in such a way that at least a portion of a stream flowing in the post-discharge area drives at least a portion of the charged species formed in the discharge area and expelled from the discharge area by electrostatic repulsion in the direction of said mixing area, wherein the dielectric barriers comprising a tube of dielectric material equipped with a flared mouth and a plate of dielectric material positioned facing the mouth of the dielectric tube, the tube of dielectric material and the plate of dielectric material defining between them a duct, and the discharge area further comprises a first annular electrode in contact with an outer wall of the dielectric tube at the flare of the dielectric tube and a second annular electrode with a diameter substantially identical to a diameter of the first electrode and in contact with the face of the dielectric plate opposite the dielectric tube, the main electrodes being adapted for generating the charged species in said discharge area.

19. The device for controlling the charge of an aerosol according to claim 18, wherein the main metal electrodes have a shape such that they are narrower on a side opposite the post-discharge area than on a side of the post-discharge area, in such a way that the resultant of the electrostatic repulsion forces exerted between the charged species formed in the discharge area is directed toward the post-discharge area.

20. The device for controlling the charge of an aerosol according to claim 18, wherein the duct has a constriction, the discharge area further comprising two secondary metal electrodes forming with the main metal electrodes a discharge area having a secondary dielectric barrier on the surface of the duct.

* * * * *